US012460883B2

(12) United States Patent
Weingandt

(10) Patent No.: US 12,460,883 B2
(45) Date of Patent: Nov. 4, 2025

(54) SELF-LOADING PISTOL

(71) Applicant: Finn Weingandt, Drage (DE)

(72) Inventor: Finn Weingandt, Drage (DE)

( * ) Notice: Subject to any disclaimer, the term of this patent is extended or adjusted under 35 U.S.C. 154(b) by 0 days.

(21) Appl. No.: 18/359,572

(22) Filed: Jul. 26, 2023

(65) Prior Publication Data

US 2024/0035765 A1 Feb. 1, 2024

(30) Foreign Application Priority Data

Jul. 29, 2022 (DE) ..... 10 2022 119 128.1

(51) Int. Cl.
*F41A 3/66* (2006.01)
*F41A 5/18* (2006.01)

(52) U.S. Cl.
CPC . *F41A 3/66* (2013.01); *F41A 5/18* (2013.01)

(58) Field of Classification Search
CPC .. F41A 3/66; F41C 23/10; F41C 23/12; F41C 27/22; F41G 1/387; F41G 1/30
USPC ..... 42/71.02
See application file for complete search history.

(56) References Cited

U.S. PATENT DOCUMENTS 4,418,487 A * 12/1983 Strahan ..... F41G 11/001 42/125
5,325,617 A 7/1994 Vojta et al.
7,451,683 B2 * 11/2008 Kellermann ..... F41A 3/66 89/196
8,448,366 B2 * 5/2013 Faifer ..... F41G 11/003 42/72
9,797,687 B2 * 10/2017 Zimmer ..... F41G 11/001
10,443,971 B2 * 10/2019 Kielsmeier ..... F41A 35/06
10,782,081 B2 * 9/2020 Porat ..... F41A 3/72
11,215,413 B2 * 1/2022 Satzinger ..... F41C 7/00
11,460,267 B2 * 10/2022 Faifer ..... F41A 3/72
2009/0282718 A1 * 11/2009 Bartley ..... F41C 23/12 42/75.03
2010/0031812 A1 2/2010 Kerbrat et al.
2012/0131829 A1 * 5/2012 Fistikchi ..... F41C 23/22 42/1.06
2013/0247440 A1 * 9/2013 Maentymaa ..... F41G 11/003 42/111

FOREIGN PATENT DOCUMENTS

AT 400 197 B 10/1995
AT 002 438 U1 10/1998
(Continued)

OTHER PUBLICATIONS

A Handgun Converter and a Method for Using a Hanggun Converter (Year: 2021).*

(Continued)

*Primary Examiner* — Reginald S Tillman, Jr.
(74) *Attorney, Agent, or Firm* — Dority & Manning, P.A.

(57) ABSTRACT

A self-loading pistol includes a housing which, in particular by means of two wall portions that are located opposite one another in the transverse direction, and a cover portion, defines a receiving region for a locking device of the self-loading pistol. In a closed state of the self-loading pistol, the locking device is received, at least in portions, inside the receiving region of the housing and is movable inside the receiving region of the housing, in particular along the longitudinal axis of the receiving region.

6 Claims, 13 Drawing Sheets

(56) References Cited

FOREIGN PATENT DOCUMENTS

| | | | | | |
|---|---|---|---|---|---|
| AT | 524 218 | A4 | | 4/2022 | |
| DE | 202014002358 | U1 | * | 7/2014 | ..... F41C 27/00 |
| DE | 202015004888 | U1 | * | 10/2015 | ..... F41C 27/00 |
| EP | 1 672 306 | B1 | | 2/2010 | |
| EP | 3825644 | A1 | * | 5/2021 | ..... F41C 23/12 |
| FR | 626 628 | A | | 9/1927 | |
| KR | 20230046004 | A | * | 4/2023 | ..... F41A 3/66 |

OTHER PUBLICATIONS

Gun Accessories, A Removable and Replaceable "gun Attachment" (Year: 2015).*
Slide Cover Apparatus of Shooting Gun (Year: 2023).*
Office Action (with English Translation) in corresponding DE Application No. 10 2022 119 128.1, dated Jul. 27, 2023, 12 pgs.
Office Action (with English Translation) in corresponding DE Application No. 10 2022 119 128.1, dated Oct. 5, 2023, 16 pgs.
The Submachine gun MP2—Uzi, Bimbel.de, https://bimbel.de/artikel/artikel-13.html, Accessed: 2023.
Uzi: full disassembly & assembly, Si vis pacem, para bellum https://youtube.com/watch?v=1Pq4GC0mMm8, Jan. 26, 2018.

* cited by examiner

SELF-LOADING PISTOL

The present application is based upon and claims the right of priority to German Patent Application No. DE 10 2022 119 128.1, filed Jul. 29, 2022, the disclosure of which is hereby incorporated by reference herein in its entirety for all purposes.

The invention relates to a self-loading pistol.

Self-loading pistols are known in principle from the prior art. Such self-loading pistols typically comprise a locking device which is movably mounted on a handle piece and/or the locking device of which constitutes an assembly that is movably placed on the handle piece and is accessible from the outside. In order to operate the self-loading pistol, for example to load the self-loading pistol, the locking device is gripped by a user of the self-loading pistol at any portion along the locking device, for example in order repeat the self-loading pistol or to close the self-loading pistol. For the movable arrangement of the locking device on the handle piece along the vertical axis "on the handle piece", the locking device and handle piece comprise corresponding guide devices, for example rails or grooves, in which the locking device is guided on the handle piece.

Since the locking device is accessible from the outside or is "placed" on the handle piece of the self-loading pistol from above, disadvantages result with respect to the shooting behavior, the ease of handling, the size and the weight of the self-loading pistol, in particular with respect to mounting external objects, such as thumb rests or mounting bases of optics devices. Since the locking device is fully accessible from the outside, i.e. typically forms the complete upper portion of the self-loading pistol, the disadvantage furthermore arises that, in the case of contact of the user or the external object with the locking device, the movement of the locking device can be braked and thus impaired. This typically results in malfunctioning of the self-loading pistol which has to be overcome by the user.

Since the locking device is moved during firing, furthermore the mounting options in the region of the locking device are greatly limited. For example, it is not readily possible to fasten external objects to the locking device. In particular, no thumb rests or similar rests can be fastened to the locking device since these would impede or block the movement of the locking device. In the case of assembly of optics on the locking device, for example red dot sights and the like, it is disadvantageous that the optics device is moved together with the locking device, which makes target detection more difficult in the case of repeated firing. In addition, mounting the optics device on the locking device increases the moving mass of the locking device, which is likewise disadvantageous for reshooting at the target after firing.

The object of the invention is that of specifying a self-loading pistol that is improved in comparison.

The object is achieved by a self-loading pistol having the features of claim 1. The dependent claims relate to advantageous embodiments.

The invention relates to a self-loading pistol which comprises a housing which, in particular by means of two wall portions that are located opposite one another in the transverse direction, and a cover portion, defines a receiving region for a locking device of the self-loading pistol, wherein in a closed state of the self-loading pistol the locking device is received, at least in portions, inside the receiving region of the housing and is movable inside the receiving region of the housing, in particular along the longitudinal axis of the receiving region.

The invention thus proposes providing a receiving region for receiving the locking device, in which region the locking device is received at least in portions. In the case of a repetition, whether initiated manually or by firing, a partial region of the locking device is moved backwards out of the receiving region of the housing. In this case, a portion of the locking device facing the cartridge chamber of the self-loading pistol remains inside the receiving region. The locking device is thus received with respect to the surroundings, by at least one portion, inside the receiving region of the housing, such that corresponding advantages result from this. In particular, a portion of the locking device is arranged inside the receiving region in every operating state of the self-loading pistol. The locking device can be dismantled, for example for maintenance purposes, in particular after the cover portion has been removed.

Depending on the specific design of the self-loading pistol described herein, the locking device can be surrounded peripherally by the housing. Openings required for repetition, for example the ejection port and an opening of the housing through which the locking device can be moved, in portions, during firing or during repetition, are provided accordingly on the housing. Embodiments are possible in which the locking device, in the closed state, is completely enclosed apart from the ejection ports and the described opening of the housing on the rear side when viewed in the firing direction. It is likewise possible, for example in order to provide suitable gripping regions on the locking device, to provide a recess or a plurality of recesses on the housing in the rear region, such that the locking device can be gripped in this region. Such embodiments are described in more detail in the following description, at a suitable point.

In other words, the invention is based on the finding that, instead of a locking device mounted on a handle piece, a housing comprising a receiving region is provided, in which receiving region the locking device is arranged and movably mounted. A portion of the locking device thus remains received in the housing or inside the receiving region and is, for example also in an open state or a state in which the locking device is maximally deflected out of the closed state, received, by a portion thereof, inside the receiving region. The locking device is thus guided inside the receiving region, wherein the housing, in particular the outer surface of the receiving region, is stationary relative to the movement of the locking device.

According to an embodiment, the housing can comprise two wall portions which for example constitute frame-like extensions of the handle piece can be rigidly connected thereto as such. The described wall portions can be combined with a cover portion which delimits the receiving region on the side opposite the handle piece of the self-loading pistol. In other words, viewed in a profile for example along the longitudinal axis or the barrel axis, the housing may have a U-shaped cross section which can be closed by the cover portion. As a result, apart from openings necessary for operation, for example ejection ports, at least a portion of the locking device is always arranged inside the receiving region and enclosed thereby peripherally. The receiving region thus constitutes a region for the locking device in which the locking device is detached relative to the surroundings or is separated therefrom.

This results in the advantage that, when handling the self-loading pistol, no unintended contact with external objects or contact of the user with the moving locking device can occur. Such unintended contact is excluded in particular on the flanks of the self-loading pistol, since there the locking device—except for ejection ports—is guided inside the receiving region and is therefore not accessible from the outside. Malfunctions of the self-loading pistol, caused by unintended contact of this kind, can thus be excluded.

A further advantage of receiving the locking device inside the receiving region is that the outer surface of the housing can be rigidly connected to the handle piece or can form an integral component of the handle piece and can thus be provided for mounting of external objects. For example, the wall portions and the cover portion of the housing are stationary relative to the locking movement, such that external objects can be mounted thereon. If for example optics are mounted on the cover portion or on one of the wall portions, this is stationary during firing, such that it is significantly easier for the user to detect the target mark or the reticle. Furthermore, the described receiving of the locking device inside the housing reduces the moving mass, since the locking device per se, as will be described in more detail below, can be reduced with respect to its dimensions and its mass, and for example optics devices and the mounting bases thereof can be mounted on the housing so as to be fixed relative to said locking device, such that these do not additionally increase the moving mass of the locking device.

In addition, the self-loading pistol described herein has the advantage that the receiving of the locking device in the receiving region is better protected against environmental influences compared with the exposed lock in the case of conventional self-loading pistols. The receiving region can for example—apart from ejection ports and openings required for repetition—be designed so as to be dust-tight, such that the introduction of foreign particles is significantly reduced, for example compared with outer guide grooves that are typically provided on self-loading pistols.

If reference is made in this description to directions or movement axes or geometric axes, the longitudinal axis refers to the axis through the longest extension of the receiving region or the locking device. The longitudinal axis can for example coincide with the barrel axis or be oriented in parallel therewith. The longitudinal axis likewise describes the movement axis of the locking device during repetition. The receiving region thus also defines a guide region in which the locking device is guided during its movement and received in part. Accordingly, the transverse direction or the transverse axis results transversely to the longitudinal axis, i.e. in particular at 90° to the longitudinal axis, and perpendicularly to the side walls or wall portions of the housing. As a result, again a vertical axis can be defined perpendicularly, i.e. perpendicularly to the transverse axis and perpendicularly to the longitudinal axis, which vertical axis is thus also perpendicular to the cover portion.

In principle, the self-loading pistol described herein can be combined with different systems or different systems can be realized for the mode of operation of the self-loading pistol. Within the context of this description, a gas pressure-retarded, i.e. an (actively) retarded, system is preferred, and the invention is described predominantly on the basis of such a system. In contrast, however, further other systems can also be implemented, for example a "Browning system" which is known in principle. The self-loading pistol is in particular distinguished from what are known as blowback action systems, since the locking device can be designed as a latching or, as in the case of the gas pressure-retarded locking device, can be designed as a retarting locking device. The self-loading pistol is designed for use and/or locking of center fire munition. The gas pressure-retarded locking system, in combination with the reception, described herein, of the locking device inside the housing, furthermore has the advantage of a barrel axis or barrel bore axis that is as low as possible, for example by the omission of the tilting movement of the barren, which is typical in particular in Browning systems. As a result, the high-impact behavior of the weapon upon firing is positively influenced. Furthermore, the described self-loading pistol allows for the use of locking springs having a comparatively low resistance, since these can and must ultimately be designed to be smaller in the case of gas pressure-retarded systems. This further improves the operation of the self-loading pistol, in particular for users who are less strong.

According to an embodiment of the self-loading pistol, it can be provided that the receiving region comprises at least one guide surface that is formed by an interior portion, in particular a wall portion of a wall element, wherein the guide surface is designed to guide the locking device during a movement of the locking device along the guide surface. As already described, the receiving region ultimately forms a delimitation between surroundings and the interior, wherein the locking device is received inside the interior. At least one interior portion of the receiving region serves, according to this embodiment, as a guide surface for guiding the locking device during its movement, for example during firing or manual repetition. Instead of guide devices typically provided in the prior art, such as rails or grooves, the locking device according to the embodiment described herein can be guided by the receiving region itself, specifically by the guide surface formed in the interior portion thereof. In this case, each of the inner surfaces of the receiving region can be designed as a guide surface. For example, the locking device slides, during its locking movement, along the guide surface and is thus guided inside the receiving region. The guide surface can also be understood as a "running surface".

The guide surface can in principle be produced from a suitable material which both allows sliding of the locking device along the guide surface and also is sufficiently rigid and wear-resistant. For example, the guide surface can be formed of a metal or a plastics material. It is likewise possible to produce the guide surface from a combination of metal and plastics material, for example from a plastics material together with metal inserts. A further possibility is that of coating the guide surface.

In principle all suitable plastics materials can be used as the plastics materials. Fiber composite materials can also be used as the plastics materials. In principle, plastics materials having any desired matrix and any desired additives can be used. For example, metal fibers, glass fibers, ceramic fibers, carbon fibers, or any other fiber and/or particle material can be used as the additive. Corresponding combinations of the individual materials in fiber or particle form are also possible. This results in particular in the advantage that complex guide devices for locking guidance can be saved, since these are likewise taken over by the receiving region in which the locking device is received.

The described self-loading pistol can furthermore be developed in that the locking device comprises a locking main body which in particular provides a breech block, from which locking main body at least one connecting flank extends to a bearing portion arranged on a side of a cartridge chamber opposite the locking main body and connects the bearing portion to the locking main body. The locking main body thus provides the breech block and ultimately denotes or encloses the part of the locking device located behind the cartridge chamber when viewed in the longitudinal direction or firing direction. The described embodiment makes it possible to ultimately reduce the lock to what is necessary for the locking function. In this case, the locking main body is comparatively compact. The mechanisms required for the firing or triggering firing, for example the breech block, the firing pin channel and the like, can be received in the locking main body.

The locking main body is connected by the at least one connecting flank to the bearing portion, which bearing portion forms the abutment for the movement of the locking main body. Ultimately, the bearing portion braces the movement of the locking main body. In particular in the case of a gas pressure-retarded locking system, the bearing portion comprises a support surface for the locking spring and the gas piston for interaction with gas removal. The bearing portion can surround the barrel and can be moved along the barrel. In the case of repetition, the bearing portion is moved from the muzzle in the direction of the cartridge chamber, while the locking spring is compressed, and, after ejection of the discharged shell, and with reduction of the spring energy of the locking spring, is moved from the direction of the cartridge chamber in the direction of the muzzle, specifically back into the closed or locked state of the locking device.

In particular, the locking main body can be connected to the bearing portion by means of two connecting flanks extending substantially in parallel with the wall portions of the housing. Alternatively, it is possible for a single connecting flank to connect the locking main body, for example extending in parallel with the cover portion, to the bearing portion. The locking portion can thus be perforated or left free in the region of the connecting flank, such that a significant reduction of material can take place in the region before the breech block in the firing direction, which significantly reduces the moving mass of the locking device. As a result, the moving mass during repetition reduces in this region, and the center of gravity of the locking device shifts onto the locking main body. This distribution of the moving mass is further advantageous for the acceleration behavior or firing behavior of the self-loading pistol during firing.

As described, the components of the housing which delimit or define the receiving region can be stationary during firing. According to a particular embodiment, the housing, in particular the wall portions defining the receiving region, can be rigidly, in particular integrally, connected to a handle piece of the self-loading pistol. In particular, the handle piece and the housing can form one piece, wherein the wall portions extend away from the handle piece in the vertical direction and the handle piece or the housing for receiving the locking device has a U-shaped profile, when viewed in the longitudinal direction, which can be closed by the cover portion.

Since a rigid connection between the housing and the handle piece thus exists, in particular the housing or the wall portions thereof are formed integrally with the handle piece, particularly safe handling results, since virtually no moving portions are provided on the flanks of the self-loading pistol—in the closed state of the self-loading pistol said portions can even be formed entirely on the inside. Contact of the user with the locking device that moves during firing is thus ultimately limited to the region behind the locking device, i.e. behind the rear opening of the housing. The housing, rigidly connected to the handle piece, can, as already described, additionally be connected to the cover portion. In the mounted state of the self-loading pistol, said cover portion is likewise rigidly connected to the housing and also to the handle piece. However, in order to improve maintenance and mounting or dismantling, the cover portion can also be separably connected to the remaining housing, i.e. can be detachable or able to be dismantled.

The cover portion can for example be rigidly connectable to the housing, in particular by means of a rail or by means of a screw connection. In this case, the housing can comprise corresponding fastening means or fastening devices, for example on the wall portions thereof, which allow for connection to the cover portion. The fastening devices on the housing are thus designed for fastening the cover portion. For example, the wall portions can comprise corresponding threaded holes, into which the cover portion can be screwed. It is likewise possible for the wall portions to form a groove or a rail, on the outside or inside, into which the cover portion can be inserted or onto which the cover portion can e pushed, respectively. The cover portion can be secured in the mounted state, for example by means of a pin or a screw.

According to a further embodiment of the self-loading pistol, it can be provided that at least one mounting surface is formed on an outer surface of the housing, in particular on an outer surface of a wall portion and/or an outer surface of the cover portion. As already described, during firing the housing is stationary relative to the locking movement of the locking device, such that mounting surfaces can be provided there for mounting external objects, for example optics devices, illumination devices, support elements, in particular thumb rests, and the like. The mounting surfaces can comprise threaded holes or continuous mounting profiles, for example dovetail rails or profiles or similar rails or rail elements. Since neither the wall portions nor the cover portion performs a movement during the repetition, objects can also be mounted on the cover portion. It is thus possible to also mount optics devices on the cover portion or other mounting surfaces which are stationary during firing and thus neither increase the moving mass nor negatively influence the aiming process on account of their movement.

As described, openings can be provided on the self-loading pistol, both on the housing and on the locking device, which openings allow for the movement sequence or the repetition. According to an embodiment of the self-loading pistol, the locking device can comprise a first ejection port and at least one wall portion of the housing comprises a second ejection port, wherein in an ejection state of the locking device the first ejection port is congruent with the second ejection port. As is known in principle in the case of self-loading pistols, after firing the shell of the fired cartridge is moved, together with the locking main body, counter to the firing direction and ejected from the ejection port. According to the present embodiment, the locking device comprises a first ejection port which has to be made congruent with the second ejection port, in the housing, in order to eject the shell.

In a closed state of the self-loading pistol, in which the breech block of the locking device touches or locks the cartridge chamber or is arranged in the region thereof, the two ejection ports are not congruent with one another. After firing the locking device moves relative to the housing, as described, such that the first ejection port is made congruent with the second ejection port. In said ejection state in which the two ejection ports are congruent with one another, the shell can thus be ejected into the surroundings, through the first and the second ejection port. The dimensioning of the ejection ports can in principle be selected as desired. In this case, the second ejection port can be formed so as to be longer or generally larger than the first ejection port. Both ports can also be the same size.

As described at the outset, it is possible in principle, in a closed state of the self-loading pistol, to receive the locking device completely in the receiving region, around the periphery, and open the housing merely at the rear, such that the locking movement of the locking device is permitted and the locking device can leave the housing in portions, at the rear, in order to carry out the repetition. In principle, in addition to the complete enclosing of the locking device around the periphery, in the closed state, it is also possible to make at least a portion of the locking device accessible from the outside, in order to allow handling by the user. According to a first embodiment, the locking device can comprise at least one gripping region at an end remote from the breech block, which gripping region protrudes from an opening of the housing, in particular along the longitudinal axis of the receiving region, or, according to a second embodiment, it can be provided for the gripping region to be received in the region of at least one recess of a wall portion of the housing, i.e. to be accessible from the outside, in particular through the recess, in particular in a closed state of the self-loading pistol.

According to the first embodiment described, receiving of the locking device that is as complete as possible can be achieved, such that unintended contact of the locking device can be virtually excluded, since this is limited to the gripping region at the rear of the locking device. If the user grips the self-loading pistol in the region of the wall portions or the cover, incorrect operation cannot result from this, since the locking device is enclosed by the housing in this region—apart from the ejection port. Interaction of the locking device is possible via the gripping region, which is formed for example as a rearward-protruding grip or annular portion and allows for operation.

According to the second embodiment described, the most compact dimensions possible of the self-loading pistol are achieved, since no additional gripping region has to be provided at the end of the locking device, but rather the locking device provides one or two opposing gripping regions at its end or end portion, and can thus be actuated by the user. Since the gripping region is limited only to the end region of the housing or of the locking device, incorrect operation or unintended braking of the locking device is also virtually excluded. The gripping region can comprise corresponding structuring, for example fluting, in order to ensure operation that is as comfortable and safe as possible for the user.

In addition to the described self-loading pistol, the invention relates to a housing for such a self-loading pistol as described above, which housing, in particular by means of two wall portions that are located opposite one another in the transverse direction, and a cover portion, defines a receiving region for a locking device of the self-loading pistol, wherein in a closed state of the self-loading pistol the locking device can be received, at least in portions, inside the receiving region of the housing and is movable inside the receiving region of the housing, in particular along the longitudinal axis of the receiving region.

In addition, the invention relates to a locking device for a self-loading pistol as described above, wherein the locking device can be received in a housing of the self-loading pistol, which housing, in particular by means of two wall portions that are located opposite one another in the transverse direction, and a cover portion, defines a receiving region for the locking device, wherein in a closed state of the self-loading pistol the locking device can be received, at least in portions, inside the receiving region of the housing and is movable inside the receiving region of the housing, in particular along the longitudinal axis of the receiving region.

In principle, all the advantages, details and features which have been described with reference to the self-loading pistol can be transferred to the housing and the locking device.

The invention will be explained in the following, on the basis of embodiments and with reference to the drawings. The drawings are schematic and, therein:

Figure 1:
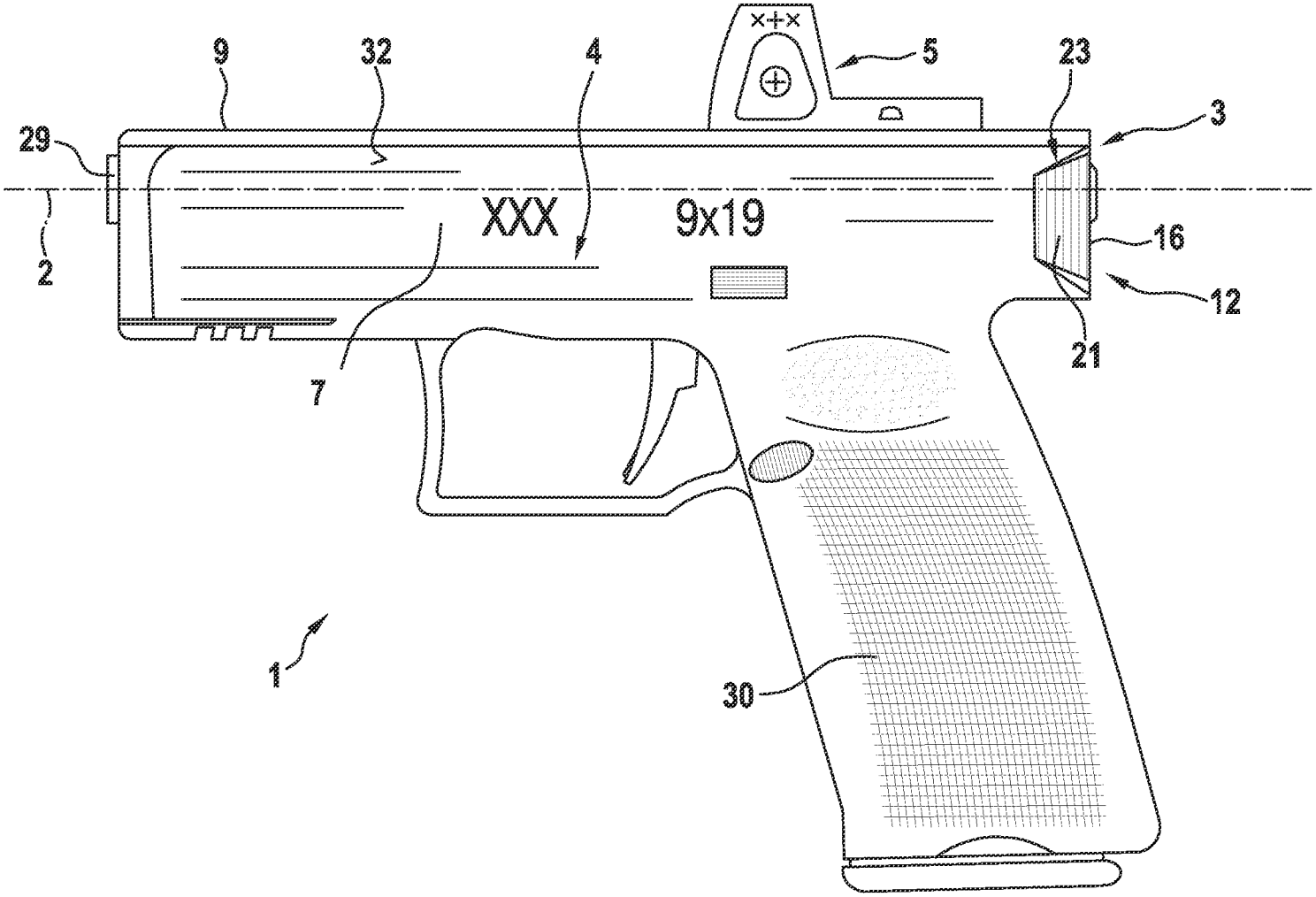
FIG. 1 is a first side view of a self-loading pistol according to one embodiment.
Figure 2:
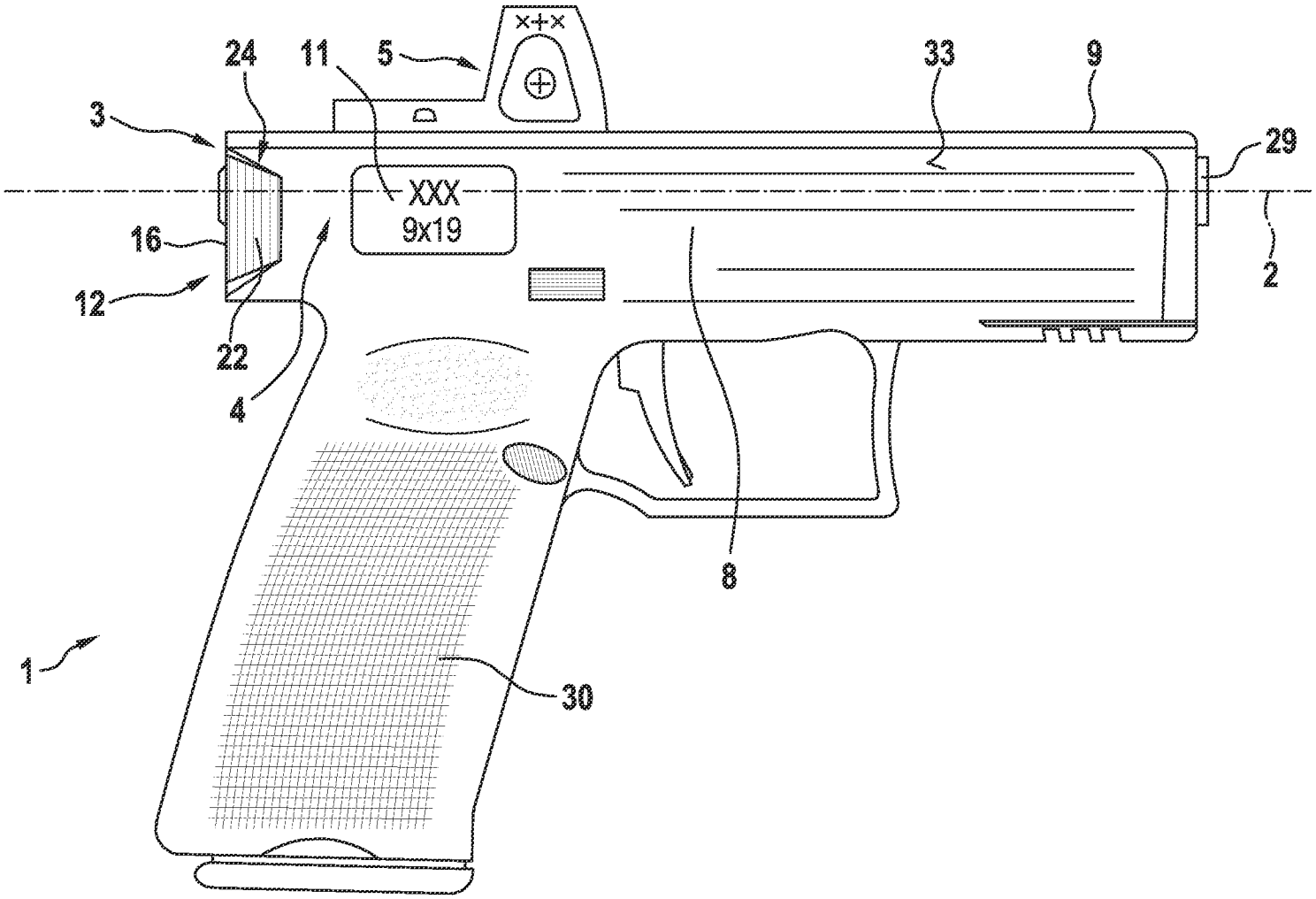
FIG. 2 is a second side view of the self-loading pistol from FIG. 1.
Figure 3:
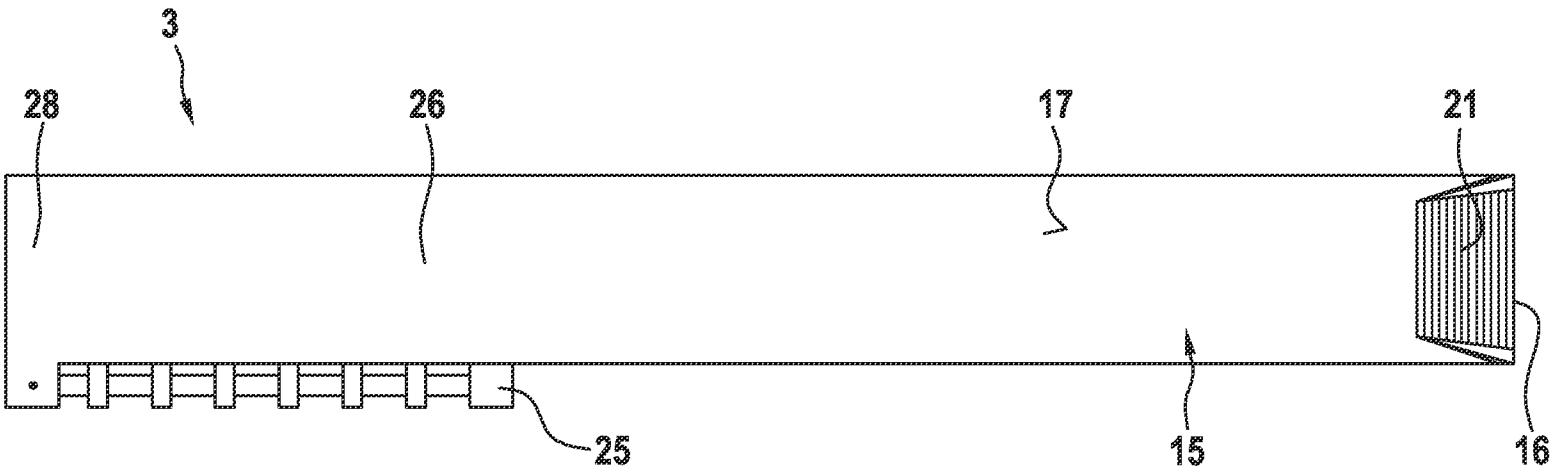
FIG. 3 is a first side view of a locking device of the self-loading pistol from FIGS. 1 and 2.

FIGS. 1 and 2 are side views of a self-loading pistol 1, wherein FIG. 1 is a first side view of the self-loading pistol 1 and FIG. 2 is a second side view of the self-loading pistol 1. The side views can be interpreted as views in a transverse direction in each case, which transverse direction is oriented perpendicularly to the longitudinal axis 2 of a locking device 3 or a housing 4 of the self-loading pistol 1. The self-loading pistol 1 is equipped in selected figures with target optics 5, for example a red dot sight, which is merely optional for the following description. For acquiring the target, the self-loading pistol 1 can be designed having any other aiming device, for example having a rear sight and front sight.

The housing 4 defines a receiving region 6 (FIG. 8-11), in particular by means of two opposing wall portions 7, 8 and a cover portion 9. The cover portion 9 is for example inserted into a corresponding groove or rail of the housing 4 or can additionally or alternatively be fastened to the housing 4 by means of pin or screw connections. The locking device 3 is received in the receiving region 6 and can be moved relative to the housing 4. In the view shown in FIGS. 1 and 2, the locking device 3 is almost completely enclosed peripherally by the housing 4.

Figure 4:
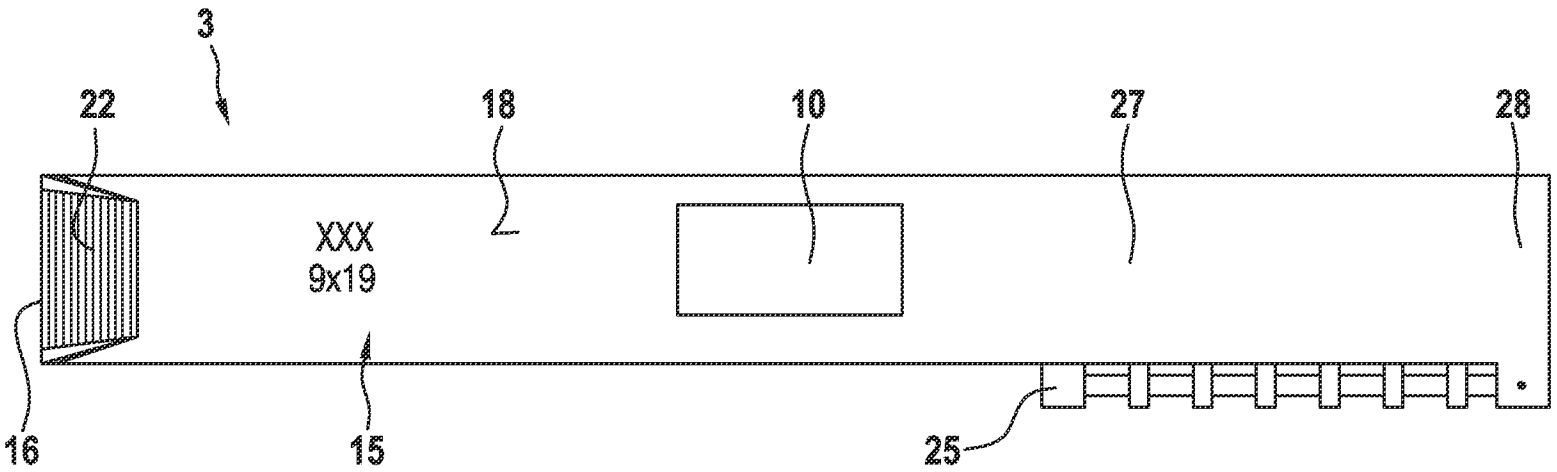
FIG. 4 is a second side view of the locking device from FIG. 3.
Figure 11:
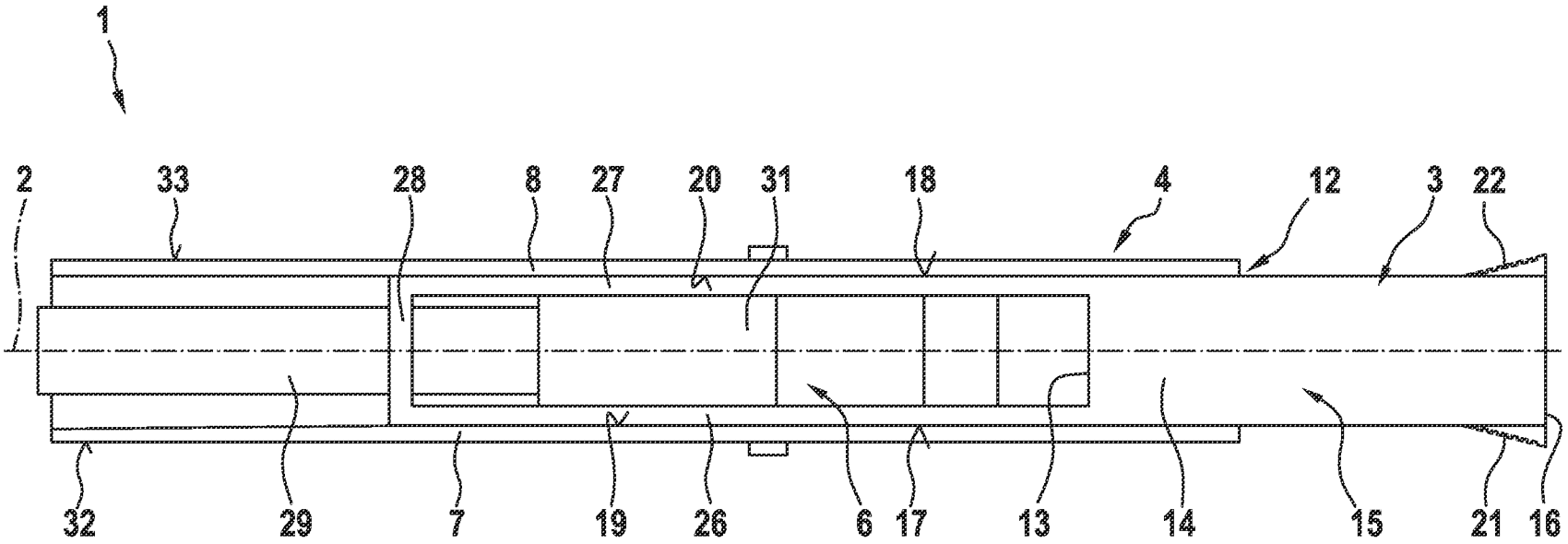
FIG. 11 is a detail of the self-loading pistol without a cover and comprising a locking device, in plan view in an open state.
Figure 12:
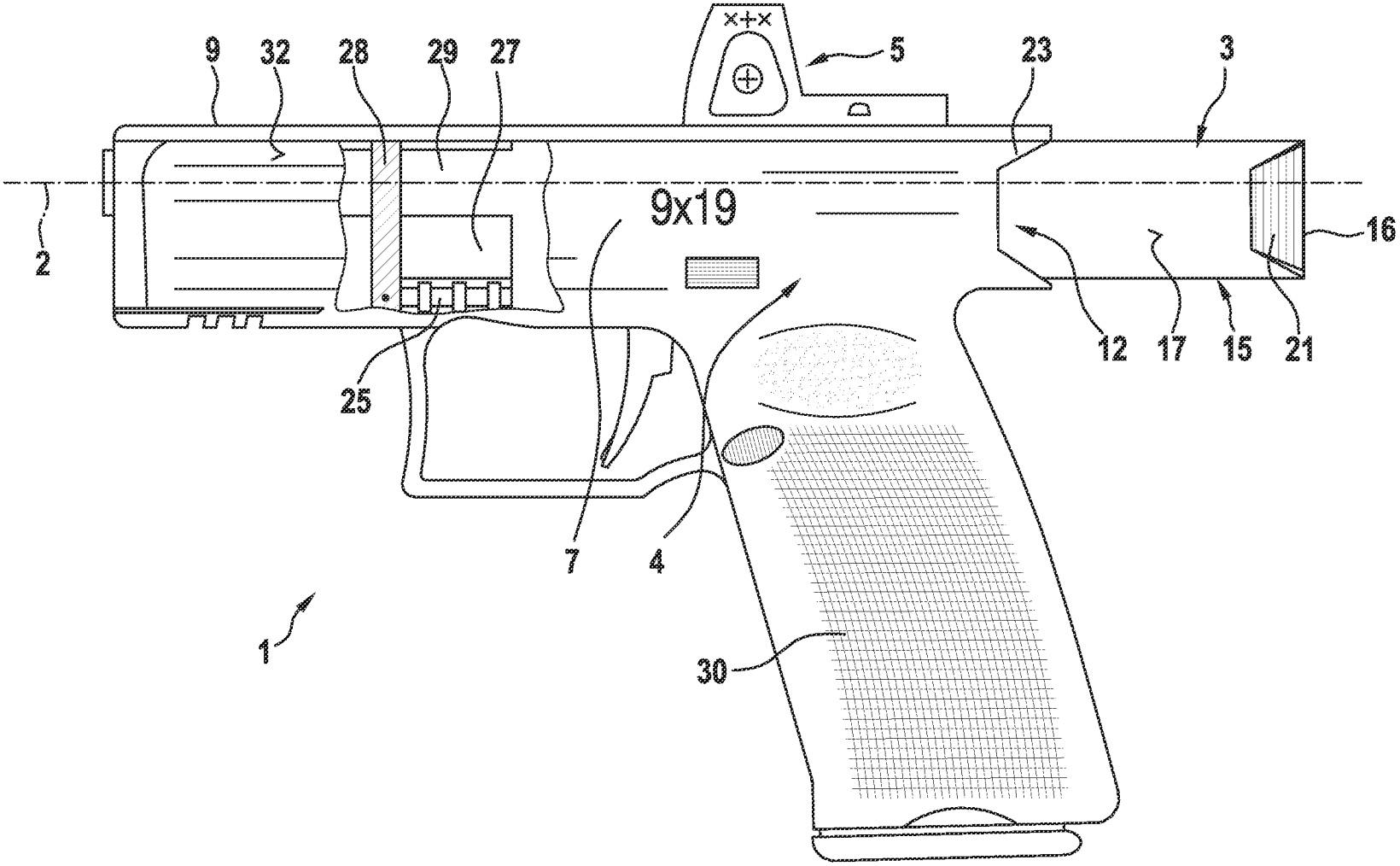
FIG. 12 is a first, partially cut away, side view of a self-loading pistol in an open state.
Figure 13:
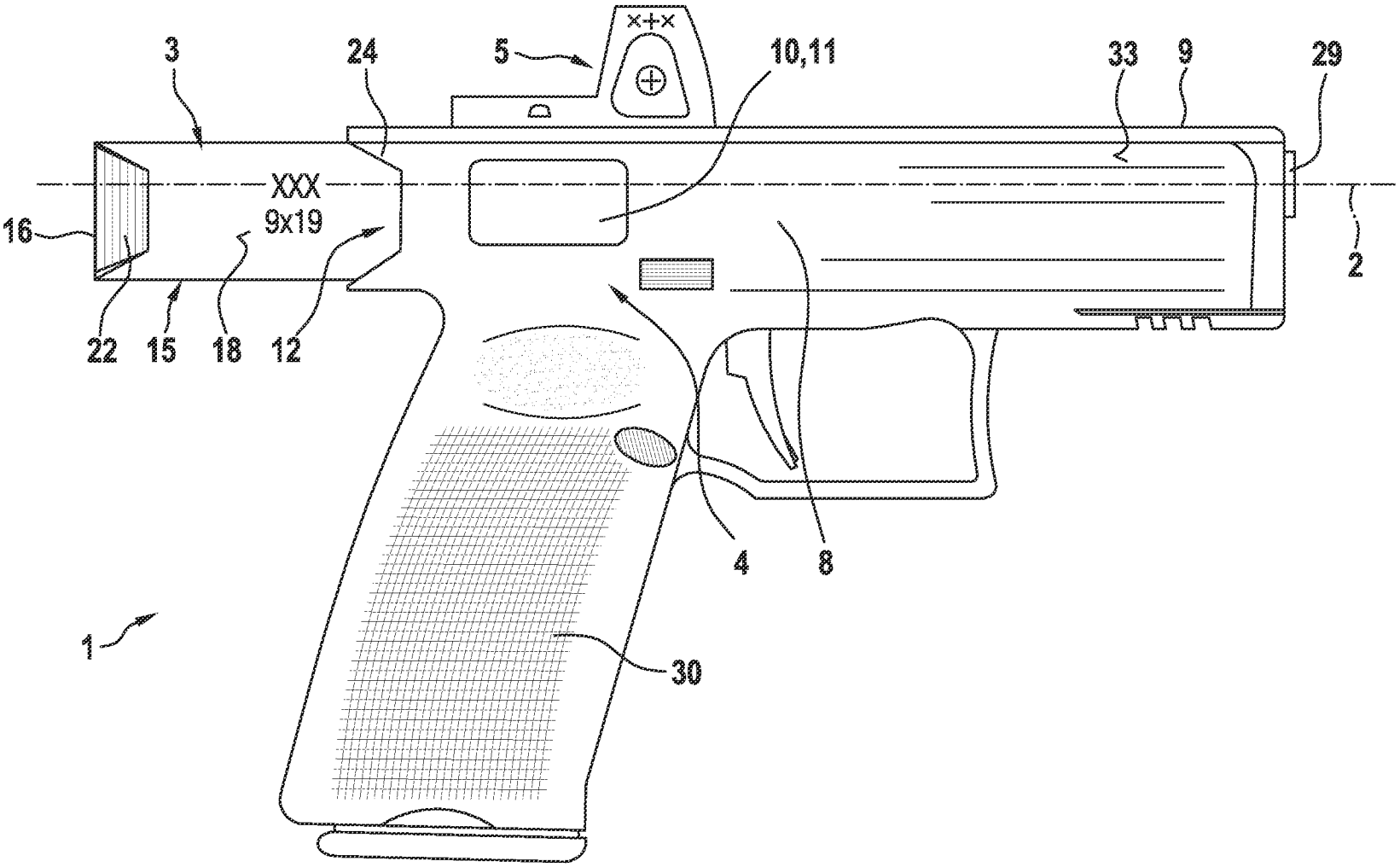
FIG. 13 is a second side view of the self-loading pistol from FIG. 12.

The locking device 3 comprises a first ejection port 10 (FIG. 4), which can be made congruent with a second ejection port 11 (FIG. 2, 13) of the housing 4 in order to eject a shell (not shown) through the two ejection ports 10, 11 into the surroundings during the repetition movement. Furthermore, in the embodiment shown in FIGS. 1 and 2 the housing 4 comprises a rear opening 12 through which the locking device 3 can leave the housing 4 in portions, in order to carry out the repetition movement. The rear opening 12 is also shown in FIG. 11-13.

It is clear that, during the repetition, the locking device 3 also moves along the longitudinal axis 2, wherein a portion 14 of the locking main body 15 comprising a breech block 13 is always located within the receiving region 6, and only an end 16 of the locking device 3 or of the locking main body 15 remote from the breech block 13 leaves the receiving region 6 via the opening 12. The repetition is described in the following description with reference to FIG. 10-13.

As can be seen from the drawings in FIGS. 1, 2 and 11-13, in the mounted state the locking device 3 is received within the receiving region 6, in the housing 4, and leaves the receiving region 6 in portions in order to carry out the repetition, specifically through the rear opening 12. In this case, lateral surfaces 17, 18 of the locking device 3 slide along guide surfaces 19, 20, which are formed by the inner portion of the receiving region 6. In the embodiment shown, the guide surfaces 19, 20 are the inner surfaces of the wall portions 7, 8. The guide surfaces 19, 20 are shown in particular in FIG. 8-11.

Furthermore, it follows from the view in FIGS. 1-7 and 11-13 that the locking device 3 can comprise gripping regions 21, 22 at its end 16, which gripping regions are located in the region of recesses 23, 24 of the housing 4, in the closed state, such that the locking device 3 can be gripped by a user and operated at the end 16, at the gripping regions 21, 22. The recesses 23, 24 and the gripping regions 21, 22 are merely optional. For the operation of the locking device 3, alternatively a gripping portion can also be arranged at the end 16, which portion adjoins the locking device 3 along the longitudinal axis 2 and protrudes beyond the opening 12 and can thus be gripped by a user.

In the closed state, the housing 4 clearly surrounds the locking device 3 or the receiving region 6 virtually completely, such that incorrect operation on account of unintended contact by the user or an external object with the moving locking device 3 can be minimized. Furthermore, the housing 4 offers protection of the locking device 3 and of the interior of the housing 4 from environmental influences, in particular the housing 4 provides protection from the penetration of foreign particles.

In FIG. 3-7, the locking device 3 is shown by way of example as a locking device 3 for a gas pressure-retarded system. In principle, the self-loading pistol 1 can implement any other locking system, for example also a Browning system. The description of the locking device 3 can be correspondingly transferred thereto. As shown in FIGS. 3-5, 7 and 12, a gas piston 25 is provided on the locking device 3, which piston, in the mounted state, is suitable for corresponding gas removal on the barrel 29 of the self-loading pistol 1 or is connected thereto, in particular a portion is inserted into the opening of the associated gas cylinder. In a manner known in principle and per se, gas can thus act on the gas piston 25, by way of the gas removal, and retard the opening of the locking device 3 until the gas can escape through the barrel 29 and thus the gas pressure in the system drops. Thereupon, the locking device 3 can open further, braked only by a comparatively weak or weaker locking spring, in order to subsequently be moved back, by said locking spring, into the (closed) initial state shown in FIGS. 1 and 2.

Figure 5:
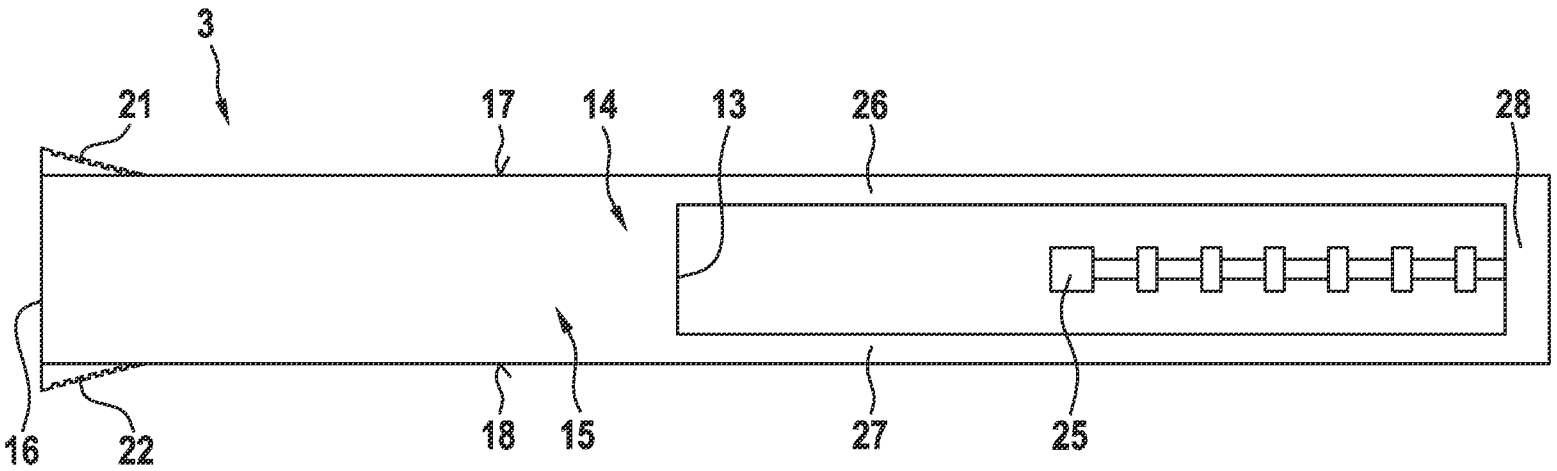
FIG. 5 is a plan view of the locking device from FIGS. 3 and 4.

In particular FIG. 5 further shows that the locking device 3 in principle comprises a comparatively compact locking main body 15 which is connected to a bearing portion 28 by, in this embodiment, two connecting flanks 26, 27. In principle it is also possible, instead of the two connecting flanks 26, 27, to provide a single connecting flank, which connects the locking main body 15, for example in parallel with the cover portion 9, to the bearing portion 28. It is clear that the region between the two connecting flanks 26, 27 is left free or is perforated, such that a reduced geometry compared with conventional locks results in a region facing the barrel 29 of the self-loading pistol 1. As a result, in particular the mass that is moved by the locking device 3 during firing is reduced, such that corresponding movements of the self-loading pistol 1 after firing can be reduced.

Figure 6:
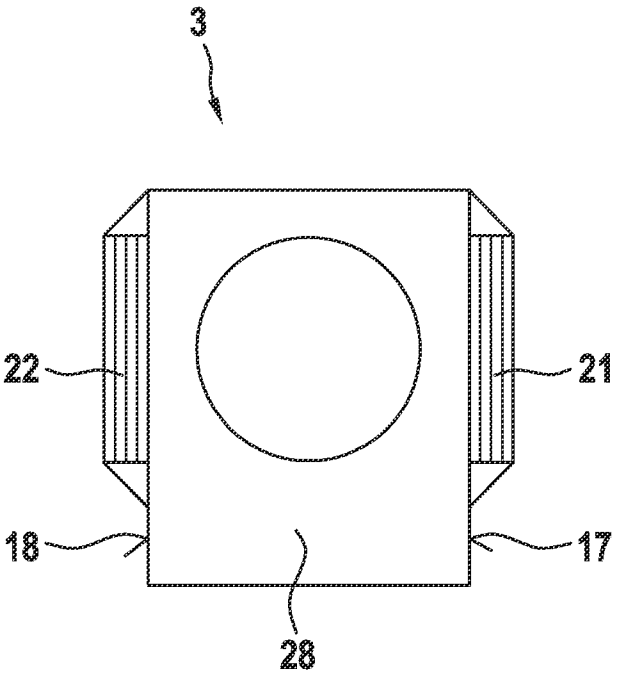
FIG. 6 is a view of the locking device from FIG. 3-5 along the longitudinal axis of the locking device, counter to the firing direction.
Figure 7:
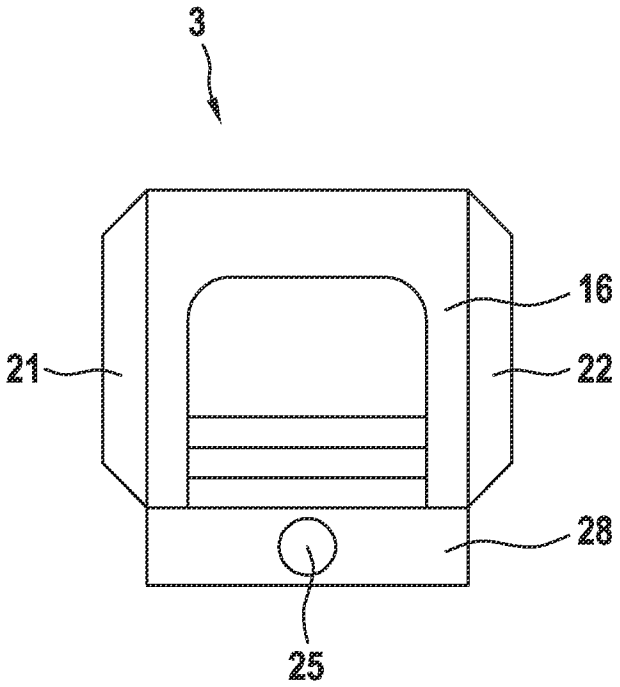
FIG. 7 is a view of the locking device from FIG. 3-6 along the longitudinal axis of the locking device, in the firing direction.
Figure 8:
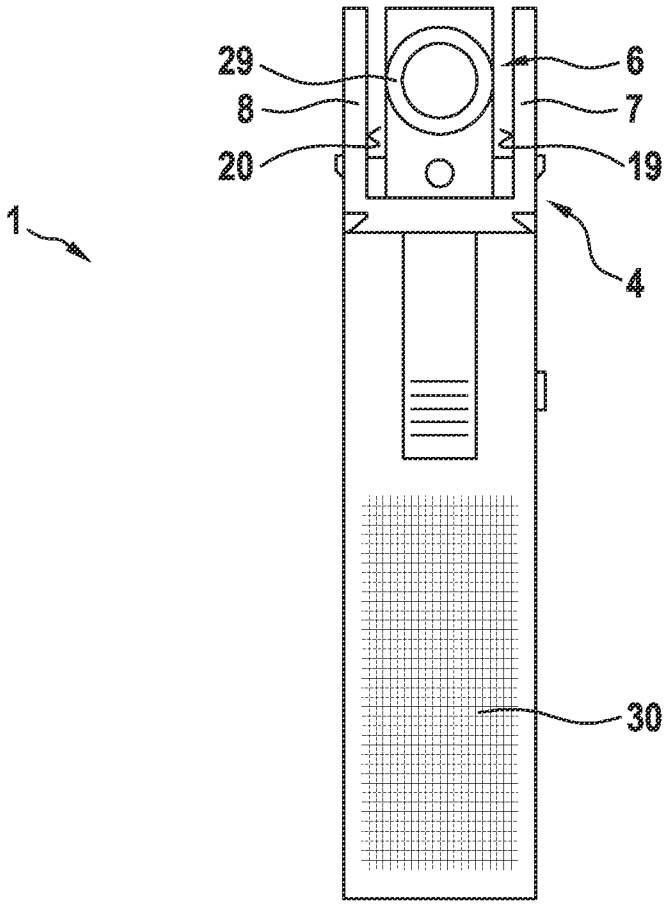
FIG. 8 is a detail of a self-loading pistol without a cover and without a locking device, viewed along the longitudinal axis counter to the firing direction.
Figure 9:
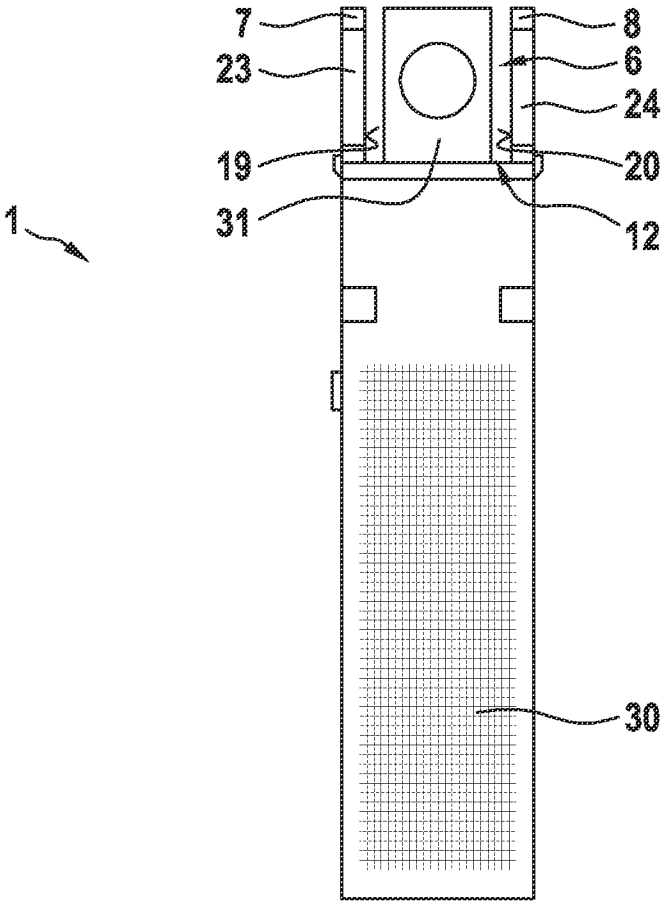
FIG. 9 is a detail of the self-loading pistol from FIG. 8, viewed along the longitudinal axis in the firing direction.
Figure 10:
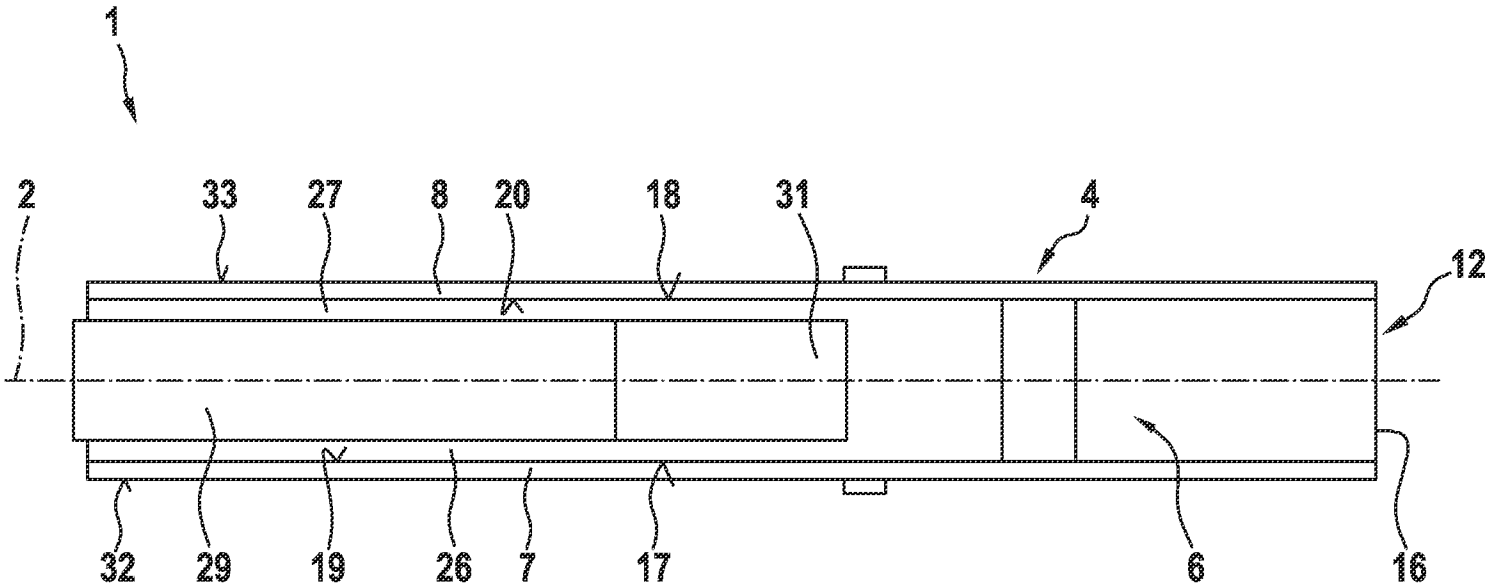
FIG. 10 is a detail of the self-loading pistol from FIGS. 8 and 9, in plan view.

For example, FIG. 6 shows that the bearing portion 28 provides an opening through which the barrel 29 (FIGS. 8, 11 and 12) can be guided. FIGS. 8 and 9 show the housing 4 of the self-loading pistol 1 when the locking device 3 is dismantled. For dismantling the locking device 3, in particular the cover portion 9 is first removed. Subsequently, the locking device 3 can be removed from the receiving region 6. In the illustration shown, the housing 4 has substantially a U-shaped profile which can be covered at its upper end, i.e. the end remote from the handle piece 30 in the direction of the vertical axis, by the cover portion 9. In the embodiment shown, the housing 4 is rigidly connected to the handle piece 30, in particular is an integral component of the handle piece 30. FIG. 10 is a plan view showing the state described above with reference to FIGS. 8 and 9.

FIG. 11-13 show the repetition of the self-loading pistol 1. In order to carry out the repetition, the locking device 3, as shown in FIG. 11, is moved along the longitudinal axis 2, counter to the firing direction, i.e. counter to the direction in which a projectile would leave the muzzle of the barrel 29. In this case, the entire housing 4, in particular the wall portions 7, 8, the cover portion 9 and the handle piece 30, remains stationary relative to the locking device 3, such that exclusively the locking device 3 moves within the receiving region 6 or out of said device, in portions, through the opening 12.

In the case of this movement, as shown broken open in FIG. 12, the bearing portion 28 is moved relative to the barrel 29. A locking spring (not shown in greater detail) is pre-tensioned when said state is assumed. As can be derived for example from FIG. 13, an ejection state is assumed in which the two ejection ports 10, 11 are made congruent, such that a shell can be ejected through the two ejection ports 10, 11. Proceeding from this state, the locking device 3 is moved back, by the locking spring (not shown in greater detail), into the closed position or into the closed state. In this case, the locking device 3 is pushed back into the housing 4, such that ultimately the closed state, as shown in FIGS. 1, 2 and 10, is present.

As is shown purely by way of example in FIGS. 1, 2, 12 and 13, the self-loading pistol 1 can comprise mounting surfaces 32, 33, which can ultimately extend along the entire outer surfaces of the housing 4. The flanks of the self-loading pistol 1 can thus function as corresponding mounting surfaces 32, 33, since no moving portion of the lock is provided in this region, as is typical in self-loading pistols. Fastening devices which are known in principle and per se, for example mounting rails, threaded holes and the like, can be provided on the mounting surfaces 32, 33, in order to be able to fasten devices to the self-loading pistol 1, such as illumination devices, thumb rests and the like.

The advantages, details and features set out with reference to the individual figures can be combined with one another, exchanged for one another, and transferred to one another as desired.

LIST OF REFERENCE CHARACTERS 1 self-loading pistol
2 longitudinal axis
3 locking device

4 housing
5 target optics
6 receiving region
7, 8 wall portion
9 cover portion
10 first ejection port
11 second ejection port
12 opening
13 breech block
14 portion
15 locking main body
16 end
17, 18 lateral surface
19, 20 guide surface
21, 22 gripping region
23, 24 recess
25 gas piston
26, 27 connecting flank
28 bearing portion
29 barrel
30 handle piece
31 cartridge chamber
32, 33 mounting surface

The invention claimed is:

1. A self-loading pistol, comprising a housing defining two wall portions that are located opposite one another in a transverse direction, and a cover portion, the two wall portions and the cover portion together defining a receiving region for a slide of the self-loading pistol, wherein the two wall portions defining the receiving region and a handle of the self-loading pistol are unitary, wherein in a closed state of the self-loading pistol the slide is received and enclosed, at least in portions, inside the receiving region of the housing and is movable inside the receiving region of the housing along a longitudinal axis of the receiving region, and wherein the slide defines a first ejection port and at least one wall portion of the two wall portions of the housing defines a second ejection port, the first ejection port aligning with the second ejection port when the slide is in an ejection state, wherein the cover portion is separably connected to the two wall portions of the housing, and wherein the slide comprises at least one gripping region at an end remote from a breech block defined in the slide, the at least one gripping region protrudes from an opening of the housing along the longitudinal axis of the receiving region or, in the closed state of the self-loading pistol, the at least one gripping region is received in the region of at least one recess of a wall portion of the two wall portions of the housing.

2. The self-loading pistol according to claim 1, wherein the receiving region comprises at least one guide surface that is formed by a wall portion of a wall element, wherein the guide surface is designed to guide the slide during a movement of the slide along the guide surface.

3. The self-loading pistol according to claim 1, wherein the slide comprises a main body which defines a breech block, at least one connecting flank extends from the main body to a bearing portion arranged on a side of a cartridge chamber opposite the main body and connects the bearing portion to the main body.

4. The self-loading pistol according to claim 1, wherein the cover portion can be rigidly connected to the two wall portions of the housing by means of a rail or by means of a screw connection.

5. The self-loading pistol according to claim 1, wherein at least one mounting surface is formed on an outer surface of a wall portion and/or an outer surface of the cover portion.

6. A housing for self-loading pistols, the housing defining two wall portions that are located opposite one another in a transverse direction, and a cover portion, the two wall portions and the cover portion defining a receiving region, wherein the two wall portions defining the receiving region and a handle of a self-loading pistol are unitary, wherein a slide of the self-loading pistol in a closed state of the self-loading pistol can be received and enclosed, at least in portions, inside the receiving region of the housing and be movable inside the receiving region of the housing along a longitudinal axis of the receiving region, and wherein at least one wall portion of the two wall portions of the housing defines an ejection port that aligns with a slide ejection port defined in the slide when the slide is in an ejection state, wherein the cover portion is separably connected to the two wall portions of the housing, and wherein the slide comprises at least one gripping region at an end remote from a breech block defined in the slide, the at least one gripping region protrudes from an opening of the housing along the longitudinal axis of the receiving region or, in the closed state of the self-loading pistol. the at least one gripping region is received in the region of at least one recess of a wall portion of the two wall portions of the housing.

* * * * *